US006279795B1

(12) United States Patent
Pierzina

(10) Patent No.: US 6,279,795 B1
(45) Date of Patent: Aug. 28, 2001

(54) SHOULDER STRAP

(75) Inventor: Ronald R. Pierzina, Bozeman, MT (US)

(73) Assignee: Quake Industries, Inc., Belgrade, MT (US)

( * ) Notice: Subject to any disclaimer, the term of this patent is extended or adjusted under 35 U.S.C. 154(b) by 0 days.

(21) Appl. No.: 09/695,535

(22) Filed: Oct. 24, 2000

Related U.S. Application Data

(63) Continuation of application No. 08/879,153, filed on Jun. 19, 1997, now abandoned.

(51) Int. Cl.[7] ..... F41C 33/00
(52) U.S. Cl. ..... 224/150; 224/264; 224/643
(58) Field of Search ..... 224/150, 264, 224/642, 643

(56) References Cited

U.S. PATENT DOCUMENTS

| | | | | |
|---|---|---|---|---|
| 1,218,967 | | 3/1917 | Willard . | |
| 2,335,222 | | 11/1943 | Storch . | |
| 2,415,961 | | 2/1947 | Nast . | |
| 2,471,258 | | 5/1949 | Bolten, Jr. . | |
| 2,910,724 | | 11/1959 | Grajeck . | |
| 3,267,191 | | 8/1966 | Williams et al. . | |
| 3,441,641 | | 4/1969 | Roberts . | |
| 3,647,505 | | 3/1972 | Bjorn-Larsen . | |
| 3,799,413 | | 3/1974 | McBain | 224/264 |
| 3,890,679 | | 6/1975 | Simon . | |
| 4,705,469 | | 11/1987 | Liebl et al. . | |
| 4,755,339 | | 7/1988 | Reilly et al. . | |
| 4,818,205 | | 4/1989 | Burke et al. . | |
| 4,830,809 | | 5/1989 | Liebl . | |
| 4,942,995 | * | 7/1990 | Myers | 224/258 |
| 5,093,067 | | 3/1992 | Gibson . | |
| 5,099,546 | | 3/1992 | Mackal . | |
| 5,250,345 | * | 10/1993 | Chu | 428/156 |
| 5,419,475 | | 5/1995 | Naritomi | 224/264 |
| 5,507,422 | | 4/1996 | Shields | 224/264 |
| 5,590,826 | * | 1/1997 | Endo | 224/264 |

* cited by examiner

*Primary Examiner*—Stephen K. Cronin
(74) *Attorney, Agent, or Firm*—Zarley, McKee, Thomte, Voorhees & Sease; Dennis L. Thomte

(57) ABSTRACT

A shoulder strap comprising a body of padding material having a flexible flat strap member embedded therein. The flat strap member is embedded in the padding material in a sinusoidal manner. A plurality of elongated indentations extend into opposite sides of the padding material and the indentations on one side of the padding material are offset longitudinally with respect to the indentations on the other side of the padding material. The device may also be used as a handle.

17 Claims, 3 Drawing Sheets

SHOULDER STRAP

CROSS-REFERENCE TO RELATED APPLICATION

This is a continuation application of Petitioner's earlier application Ser. No. 08/879,153 filed Jun. 19,1997, entitled A SHOULDER STRAP.

BACKGROUND OF THE INVENTION

1. Field of the Invention

This invention relates to a padded carrying strap for carrying a load from the shoulder. Additionally, this invention relates to a means for padding the handle on an item to be hand-carried such as a bag or the like.

2. Description of the Related Art

Conventional carrying straps normally comprise a length-adjustable leather or webbing which is secured by swivels or the like to enable the object to be carried over the shoulder. Further, conventional straps sometimes tend to slip or roll from the shoulder.

SUMMARY OF THE INVENTION

A padded strap is provided which may be used for rifles, shotguns, crossbows, briefcases, bowling bags, etc. Further, the invention herein may be used to provide a padded handle for articles which are to be hand-carried.

In all of the embodiments herein, an elongated, flexible, flat strap member is embedded in a body of padding material. The body of padding material has a plurality of first elongated, spaced-apart indentations or channels extending into one of the sides thereof and has a plurality of second elongated, spaced-apart indentations or channels extending into the other side thereof. Each of the elongated indentations or channels has a longitudinal axis which is disposed substantially transversely to the longitudinal axis of the strap member. The flexible strap member is embedded in the body of padding material in a substantially sinusoidal fashion. The first indentations in the body of padding material are offset longitudinally with respect to the second indentations, with the indentations extending sufficiently inwardly into the body of padding material so as to at least partially expose the strap member. When the device is to be used as a sling for a rifle or shotgun, one of the opposite ends of the body of padding material has a width which is greater than the width of the other end of the body of padding material.

The purpose of the sinusoidal or weaving pattern of the strap through the padding is so that the weight of the load will not be completely supported by the strap, but by a combination of the strap and the body of padding material. The design of the body of padding material is such that it will not tend to slide or roll from the user's shoulder. Although the invention is ideally suited for use as shoulder straps, the invention may be used for supporting a load on the shoulder or facilitating the hand-carrying of a load.

It is therefore a principal object of the invention to provide an improved padded shoulder strap or hand strap.

A further object of the invention is to provide a padded shoulder strap which does not slip or roll from the user's shoulder.

Yet another object of the invention is to provide a padded shoulder strap which includes a strap member embedded in a thermoplastic rubber material with the strap member being embedded in the padding material in a sinusoidal fashion.

Yet another object of the invention is to provide a shoulder strap which includes a plurality of indentations on opposite sides of the body of padding material to create hinges and to ensure that the weight of the load will not be completely supported by the strap member, but by a combination of the strap member and the body of padding material.

Still another object of the invention is to provide a padded shoulder strap.

Still another object of the invention is to provide a padded handle.

Still another object of the invention is to provide a padded member for use on a shoulder strap.

These and other objects will be apparent to those skilled in the art.

DESCRIPTION OF THE PREFERRED EMBODIMENT

Figure 1:
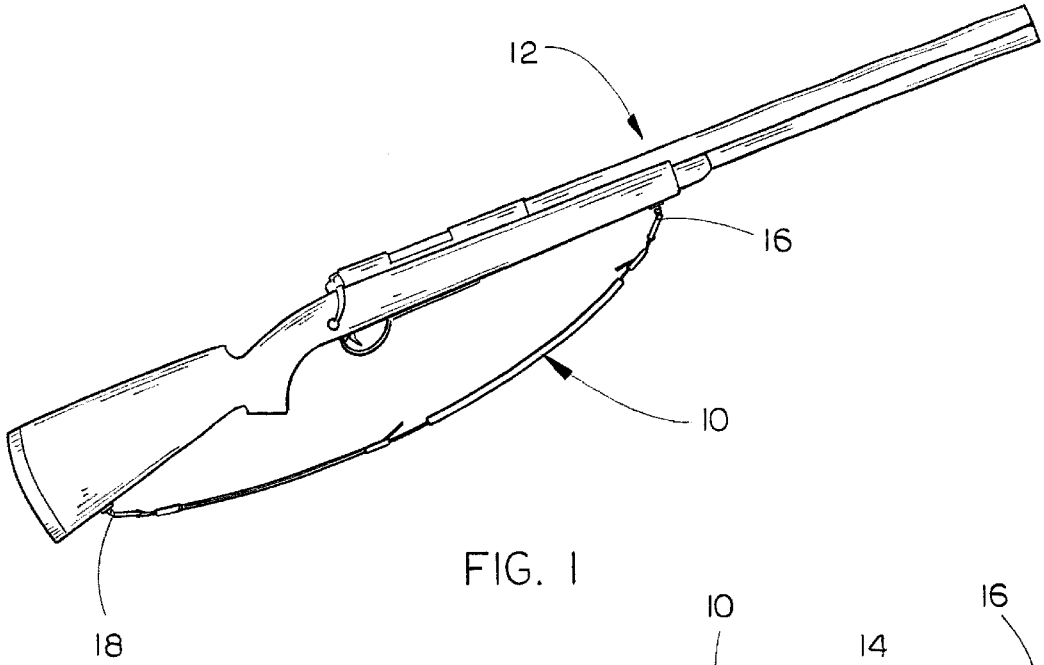
FIG. 1 is a perspective view of a rifle having the sling of this invention mounted thereon.
Figure 2:
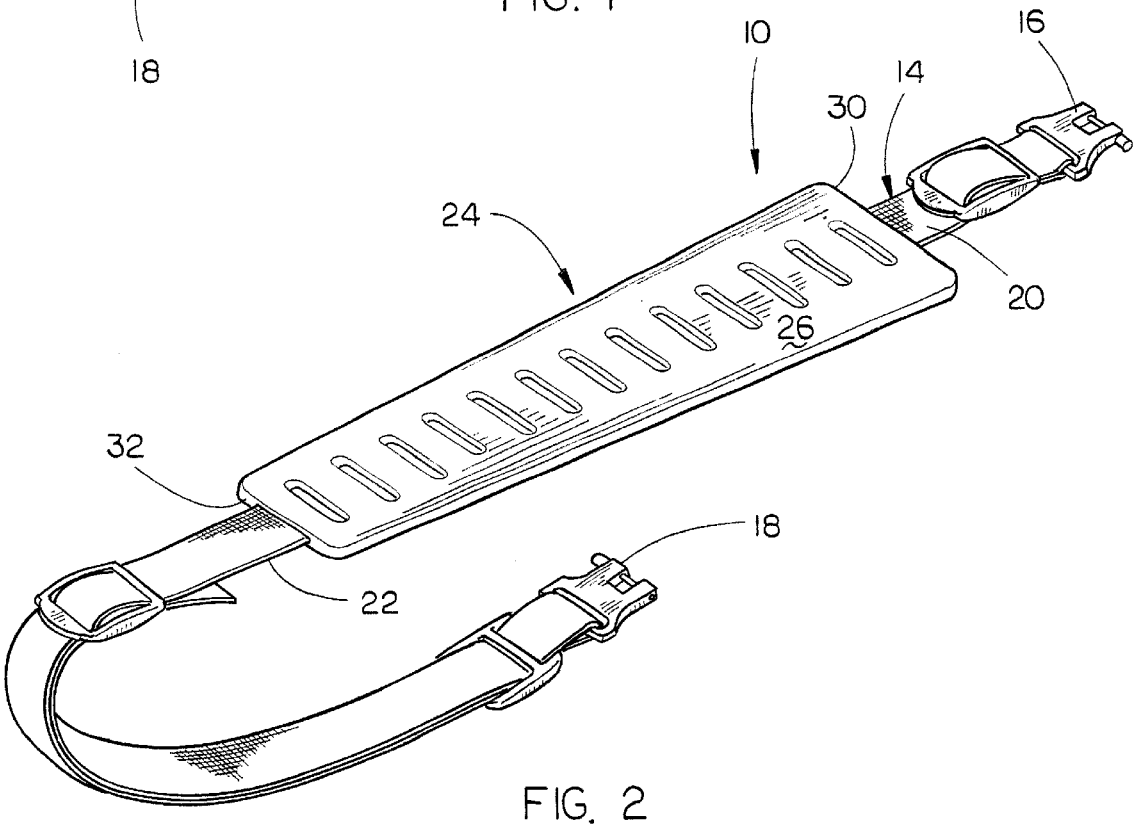
FIG. 2 is a perspective view of the sling of this invention.

The sling of this invention is referred to generally by the reference numeral 10 and is designed for use with a rifle 12 or a shotgun (not shown). Further, the sling 10 of this invention could be used with a crossbow or other weapon which is to be carried over the shoulder by the shooter, hunter, user, etc. Sling 10 includes an elongated, flat, flexible strap member 14 preferably comprised of a polypropylene material and having connectors 16 and 18 at the opposite ends thereof which are adapted to be connected to the rifle 12, as illustrated in FIG. 1.

Figure 5:
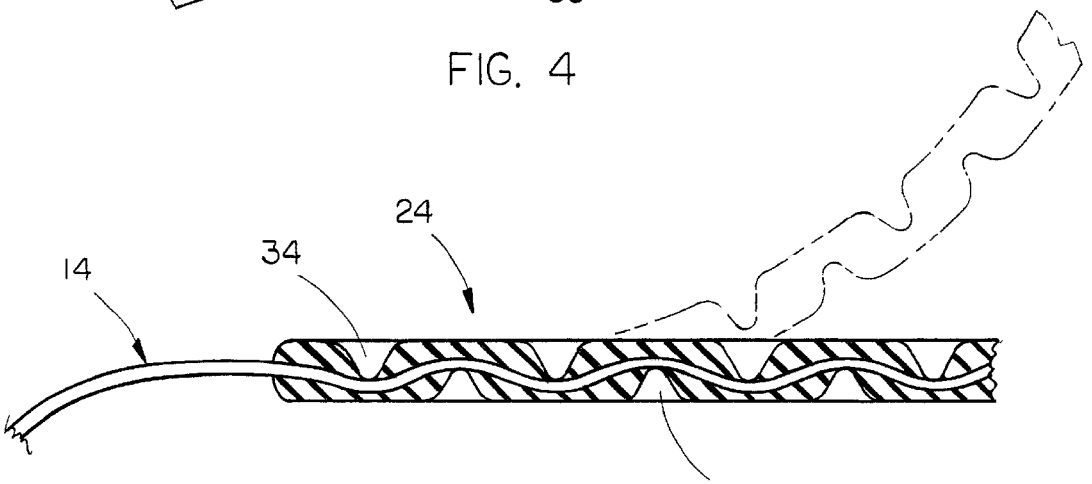
FIG. 5 is a sectional view as seen on lines 5—5 of FIG. 3 with the broken lines illustrating the manner in which the sling may flex.

In the drawings, strap member 14 will be described as having a top surface 20 and a bottom surface 22. The strap member 14 is embedded in a body of padding material referred to generally by the reference numeral 24. For ease of description, the body padding material 24 will be referred to as a pad. Pad 24 includes a top surface 26 and a bottom surface 28. Pad 24 also includes opposite ends 30 and 32. As seen in FIG. 5, strap member 14 is embedded in pad 24 in a sinusoidal fashion. Another way of describing the configuration of the embedded strap member 14 is to say that the strap member 14 is embedded in such a manner as to provide a weave effect. Preferably, pad 24 is comprised of a thermoplastic rubber material.

Figure 3:
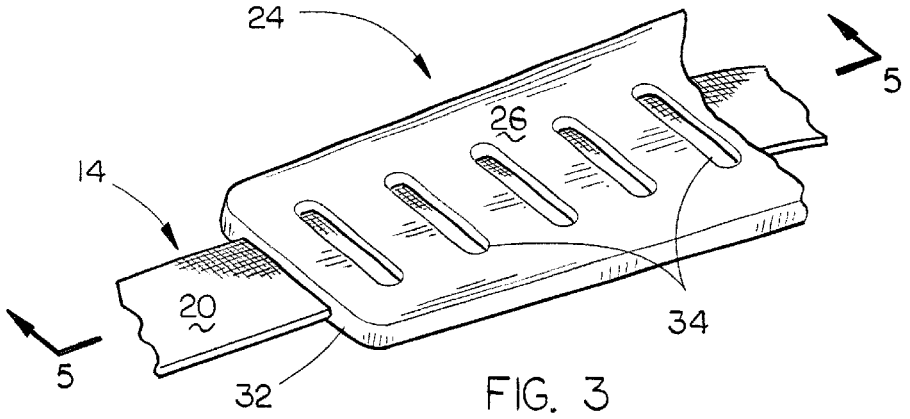
FIG. 3 is a partial top perspective view of the sling of FIG. 2.
Figure 4:
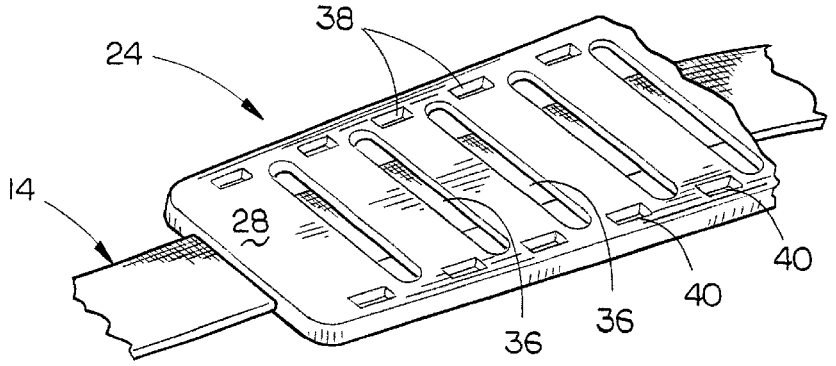
FIG. 4 is a partial bottom perspective view of the sling of FIG. 2.

Upper surface 26 of pad 24 is provided with a plurality of elongated indentations or channels 34 extending thereinto, as illustrated in FIG. 3, so that at least a portion of the strap member 14 is exposed, as illustrated in FIG. 3. Similarly, the bottom surface 28 of pad 24 is provided with a plurality of indentations or channels 36 formed therein which extend inwardly thereinto so that strap member 14 is partially exposed in the indentation. It is important to note that the indentations 34 and 36 only extend inwardly to approximately strap member 14 to create hinge lines in the pad. It is also important to note that the indentations 34 are offset longitudinally with respect to the indentations 36 so that indentations 34 are not directly opposite to indentations 36. Bottom surface 28 of pad 24 is also provided with a plurality of elongated openings 38 formed therein adjacent one side thereof and elongated openings 40 formed therein adjacent the other side of the pad 24. When the device is to be used as a rifle or shotgun sling, it is preferred that the end 30 of the pad 24 have a width which is greater than the end 32 which tends to properly maintain the pad 24 of the sling 10 on the shooter's shoulder.

Figure 6:
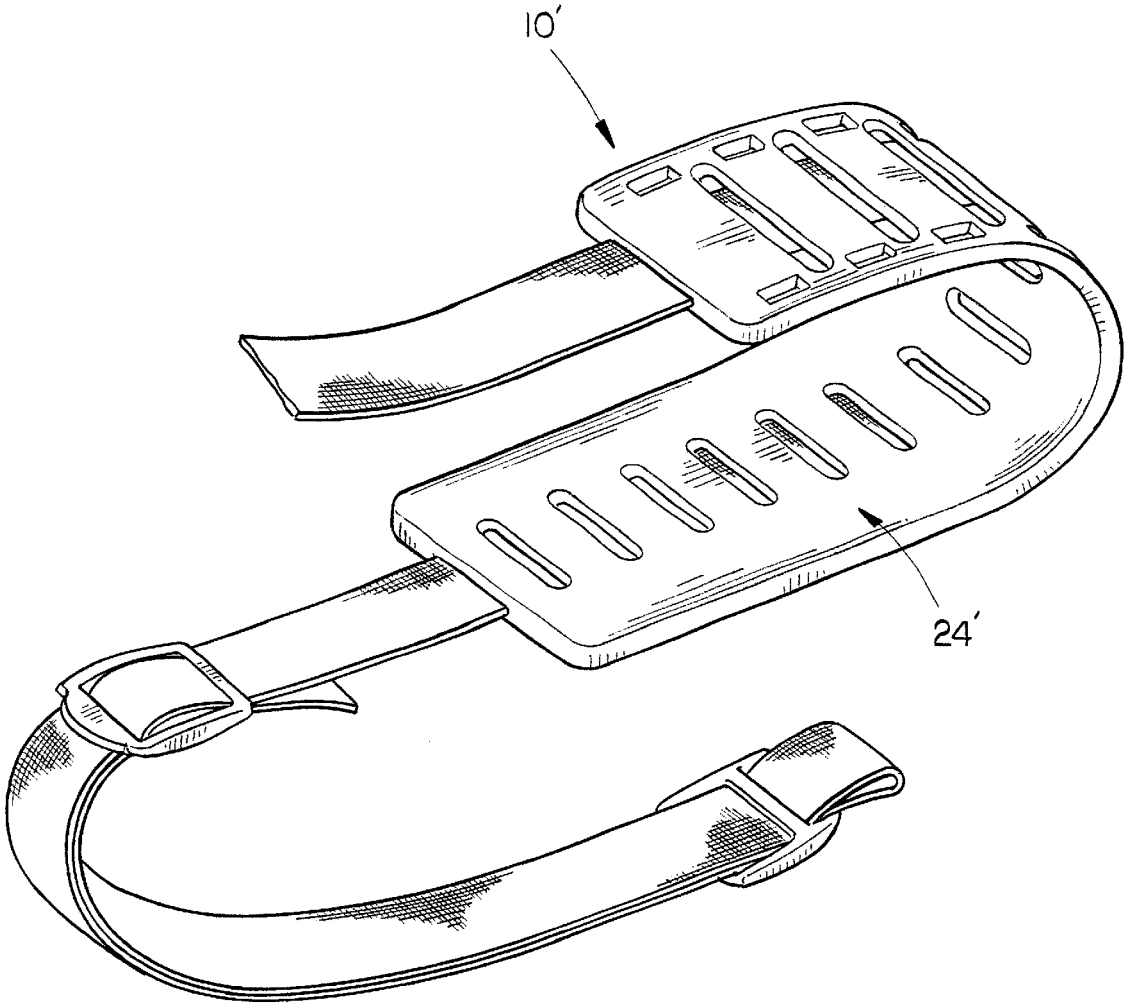
FIG. 6 is a perspective view of a modified form of the invention suitable for use as a shoulder strap.

FIG. 6 illustrates a further embodiment of the invention and is referred to generally by the reference numeral 10'. The only difference between the device 10' and the device 10 is that the device 10' may be used as a shoulder strap for carrying bags or the like. In such an embodiment, it is not felt that it is necessary to have one end of the pad 24' to be wider than the other end thereof as in the sling 10. Further, the structure seen in FIG. 6 could also be easily adapted to be used as a handle for a bag to be hand-carried. The primary function of the invention herein is to ease the burden of carrying a load from the shoulder or to help the grip of a handle while being easy on the hand or shoulder. The "soft touch" feature provides these functions.

The invention is formed as follows. The strap member 14 is clamped to a fixture which is then positioned in a thermoplastic mold. The strap member is positioned so the closing of the mold holds the strap tightly in place so that the injecting of thermoplastic rubber will not shift the strap member during processing. The mold is constructed so that when the mold closes, the strap member is pushed off center by strategically placed cores creating a weave or sinusoidal effect. The purpose of the sinusoidal or weave effect is so that the weight of the load will not be completely supported by the strap member, but by a combination of the strap member and the thermoplastic rubber.

In use as a sling, the sling will not slide or roll off the user's shoulder and eliminates "bounce fatigue". The device of this invention is extremely comfortable to use whether it is supporting a rifle, shotgun, crossbow, shoulder bag or hand bag.

Thus it can be seen that the invention accomplishes at least all of its stated objectives.

I claim:

1. A rifle sling, comprising:

a body of padding material having opposite ends, opposite side edges, and opposite surfaces;

an elongated, flexible, flat strap member embedded in said body of padding material to adhere and affix the strap within the padding and form an integral unit, and having opposite ends extending from the said opposite ends of said body of padding material;

said body of padding material having a plurality of first elongated, spaced-apart indentations extending into one of said surfaces of said body of padding material;

said body of padding material having a plurality of second elongated, spaced-apart indentations extending into the other of said surfaces of said body of padding material;

each of said elongated indentations having a longitudinal axis which is disposed substantially transversely to the longitudinal axis of said strap member.

2. The rifle sling of claim 1 wherein said strap member is comprised of a polypropylene material.

3. The rifle sling of claim 1 wherein said padding material is comprised of a thermoplastic rubber material.

4. The rifle sling of claim 1 wherein the said first indentations are offset longitudinally with respect to the said second indentations.

5. The rifle sling of claim 1 wherein said indentations extend sufficiently inwardly into said padding material so as to at least partially expose said strap member.

6. The rifle sling of claim 1 wherein one of said opposite ends of said padding material has a width which is greater than the width of the other of said opposite ends of said padding material.

7. The rifle sling of claim 1 wherein said other surface has a plurality of longitudinally extending, spaced-apart first openings formed therein adjacent one side edge thereof and a plurality of longitudinally extending, spaced-apart second openings formed therein adjacent the other side edge thereof.

8. The rifle sling of claim 1 wherein said strap member is embedded in said body of padding material in a substantially sinusoidal fashion.

9. The rifle sling of claim 8 wherein the sinusoidal orientation of the strap includes ridge portions and valley portions, and wherein each first indentation is aligned with each ridge portion and wherein each second indentation is aligned with each valley portion.

10. A strap comprising:

a body of padding material having opposite ends, opposite side edges, and opposite surfaces;

an elongated, flexible, flat strap member embedded in said body of padding material to adhere and affix the strap within the padding and form an integral unit, and having opposite ends extending from the said opposite ends of said body of padding material;

said body of padding material having a plurality of first elongated, spaced-apart indentations extending into one of said surfaces of said body of padding material;

said body of padding material having a plurality of second elongated, spaced-apart indentations extending into the other of said surfaces of said body of padding material;

each of said elongated indentations having a longitudinal axis which is disposed substantially transversely to the longitudinal axis of said strap member.

11. The strap of claim 10 wherein said strap member is comprised of a polypropylene material.

12. The strap of claim 10 wherein said padding material is comprised of a thermoplastic rubber material.

13. The strap of claim 10 wherein the said first indentations are offset longitudinally with respect to the said second indentations.

14. The strap of claim 10 wherein said indentations extend sufficiently inwardly into said padding material so as to at least partially expose said strap member.

15. The strap of claim 10 wherein said other surface has a plurality of longitudinally extending, spaced-apart first openings formed therein adjacent one side edge thereof and a plurality of longitudinally extending, spaced-apart second openings formed therein adjacent the other side edge thereof.

16. The strap of claim 10 wherein said strap member is embedded in said body of padding material in a substantially sinusoidal fashion.

17. The strap of claim 16 wherein the sinusoidal orientation of the strap includes ridge portions and valley portions, and wherein each first indentation is aligned with each ridge portion and wherein each second indentation is aligned with each valley portion.

* * * * *